US008186452B1

(12) United States Patent
White et al.

(10) Patent No.: US 8,186,452 B1
(45) Date of Patent: May 29, 2012

(54) CLAMPING SYSTEMS AND METHODS FOR PILEDRIVING

(75) Inventors: John L. White, Kent, WA (US); David Yingling, Covington, WA (US)

(73) Assignee: American Piledriving Equipment, Inc., Kent, WA (US)

( * ) Notice: Subject to any disclaimer, the term of this patent is extended or adjusted under 35 U.S.C. 154(b) by 42 days.

(21) Appl. No.: 11/540,250

(22) Filed: Sep. 29, 2006

Related U.S. Application Data

(60) Provisional application No. 60/722,748, filed on Sep. 30, 2005.

(51) Int. Cl.
*E02D 7/00* (2006.01)

(52) U.S. Cl. ..... 173/90; 173/184; 173/1

(58) Field of Classification Search ..... 173/49, 173/90, 27–28, 184, 185; 175/56; 405/231, 405/232, 249, 239, 256; 52/649.3, 649.4; 414/746.5, 723; 172/272, 247; 37/468, 406; 279/2.12, 2.03; 269/74, 79, 229, 231
See application file for complete search history.

(56) References Cited

U.S. PATENT DOCUMENTS

| | | | | |
|---|---|---|---|---|
| 628,962 | A | 7/1899 | Speer | |
| 1,213,800 | A | 1/1917 | Piper | |
| 1,787,000 | A | 12/1930 | Hunt | |
| 2,068,045 | A * | 1/1937 | Wohlmeyer | 173/18 |
| 3,115,198 | A | 12/1963 | Kuss | |
| 3,149,851 | A | 9/1964 | Adams | |
| 3,172,485 | A | 3/1965 | Spannhake et al. | |
| 3,177,029 | A | 4/1965 | Larson | |
| 3,227,483 | A * | 1/1966 | Guild et al. | 294/88 |
| 3,243,190 | A | 3/1966 | Peregrine | |
| 3,289,774 | A * | 12/1966 | Bodine, Jr. | 175/19 |
| 3,300,987 | A | 1/1967 | Maeda | |
| 3,371,727 | A | 3/1968 | Belousov et al. | |
| 3,391,435 | A | 7/1968 | Lebelle | |
| 3,530,947 | A | 9/1970 | Gendron | |
| 3,620,137 | A | 11/1971 | Prasse | |
| 3,686,877 | A | 8/1972 | Bodin | |

(Continued)

FOREIGN PATENT DOCUMENTS

DE 4010357 10/1990

(Continued)

OTHER PUBLICATIONS

ICE, "Hydraulic Vibratory Driver/Extractors for Piling and Caisson Work", Reference No. V7-0890-51, date unknown, 3 pages.

(Continued)

*Primary Examiner* — Rinaldi I. Rada
*Assistant Examiner* — Michelle Lopez
(74) *Attorney, Agent, or Firm* — Michael R. Schacht; Schacht Law Office, Inc.

(57) ABSTRACT

A clamp system for an elongate member, comprising first and second clamp members, an actuator member, and an actuator system. The actuator member defines an actuator cam surface and is supported for movement between first and second actuator positions. The second clamp member defines a clamp cam surface and is supported for movement between first and second clamp positions. The actuator system displaces the actuator member between first and second actuator positions. As the actuator member moves from the first actuator position to the second actuator position, the actuator cam surface engages the clamp cam surface to cause the second clamp member to move towards the first clamp member, thereby clamping a portion of the elongate member between the first and second clamp members.

14 Claims, 10 Drawing Sheets

U.S. PATENT DOCUMENTS

| | | | | | |
|---|---|---|---|---|---|
| 3,720,435 | A | | 3/1973 | Leyn | |
| 3,734,209 | A | | 5/1973 | Haisch et al. | |
| 3,828,864 | A | * | 8/1974 | Haverkamp et al. | 173/49 |
| 3,871,617 | A | | 3/1975 | Majima | |
| 3,959,557 | A | | 5/1976 | Berry | |
| 3,998,063 | A | | 12/1976 | Harders | |
| 4,018,290 | A | | 4/1977 | Schmidt | |
| 4,067,369 | A | | 1/1978 | Harmon | |
| 4,099,387 | A | | 7/1978 | Frederick et al. | |
| 4,100,974 | A | * | 7/1978 | Pepe | 173/49 |
| 4,113,034 | A | * | 9/1978 | Carlson | 173/49 |
| 4,119,159 | A | * | 10/1978 | Arentsen | 173/133 |
| 4,180,047 | A | | 12/1979 | Bertelson | |
| 4,248,550 | A | | 2/1981 | Blaschke et al. | |
| 4,505,614 | A | | 3/1985 | Anschutz | |
| 4,758,148 | A | | 7/1988 | Jidell | |
| 4,961,471 | A | * | 10/1990 | Ovens | 175/170 |
| 5,076,090 | A | | 12/1991 | Cetnarowski | |
| 5,088,565 | A | * | 2/1992 | Evarts | 173/49 |
| 5,117,925 | A | | 6/1992 | White | |
| 5,213,449 | A | | 5/1993 | Morris | |
| 5,263,544 | A | | 11/1993 | White | |
| 5,355,964 | A | | 10/1994 | White | |
| 5,375,897 | A | | 12/1994 | Gazel-Anthoine | |
| 5,409,070 | A | | 4/1995 | Roussy | |
| 5,544,979 | A | | 8/1996 | White | |
| 5,549,168 | A | | 8/1996 | Sadler et al. | |
| 5,609,380 | A | * | 3/1997 | White | 294/104 |
| 5,653,556 | A | | 8/1997 | White | |
| 5,794,716 | A | | 8/1998 | White | |
| 5,918,511 | A | * | 7/1999 | Sabbaghian et al. | 81/128 |
| 6,039,508 | A | | 3/2000 | White | |
| 6,216,394 | B1 | | 4/2001 | Fenelon | |
| 6,386,295 | B1 | | 5/2002 | Suver | |
| 6,427,402 | B1 | | 8/2002 | White | |
| 6,431,795 | B2 | | 8/2002 | White | |
| 6,447,036 | B1 | | 9/2002 | White | |
| 6,484,553 | B1 | * | 11/2002 | Devers | 72/402 |
| 6,543,966 | B2 | | 4/2003 | White | |
| 6,557,647 | B2 | | 5/2003 | White | |
| 6,582,158 | B1 | | 6/2003 | Van Stein | |
| 6,648,556 | B1 | | 11/2003 | White | |
| 6,652,194 | B2 | | 11/2003 | Ingle | |
| 6,672,805 | B1 | | 1/2004 | White | |
| 6,732,483 | B1 | | 5/2004 | White | |
| 6,736,218 | B1 | | 5/2004 | White | |
| 6,860,338 | B2 | * | 3/2005 | Salesse et al. | 173/49 |
| 6,896,448 | B1 | | 5/2005 | White | |
| 6,908,262 | B1 | | 6/2005 | White | |
| 6,988,564 | B2 | | 1/2006 | White | |
| 7,043,806 | B2 | * | 5/2006 | Schrock et al. | 29/237 |
| 7,168,890 | B1 | | 1/2007 | Evarts | |
| 7,824,132 | B1 | | 11/2010 | White | |
| 2005/0013675 | A1 | * | 1/2005 | Bengston et al. | 409/231 |
| 2006/0113456 | A1 | * | 6/2006 | Miller | 248/545 |

FOREIGN PATENT DOCUMENTS

| | | | | |
|---|---|---|---|---|
| DE | 4010357 | A1 | | 10/1990 |
| DE | 102006053482 | A1 | * | 6/2008 |
| EP | 0 172 960 | | | 5/1986 |
| EP | 0526743 | | | 2/1993 |
| GB | 2028902 | | | 3/1980 |
| GB | 2 043 755 | | | 10/1980 |
| JP | 6 136751 | | | 5/1994 |

OTHER PUBLICATIONS

ICE, "Hydraulic Vibratory Driver/Extractors for Piling and Caisson Work", date unknown, 10 pages.

ICE, "Diesel Pile Hammers", Reference No. DH4-1288-5C, date unknown, 6 pages.

APE, "APE Model 8 Hydraulic Impact Hammer", date unknown, 1 page.

MKT Geotechnical Systems, "Operating, Maintenance and Parts Manual for MS350 and MS500 Single-Acting Pile Hammers", Manual No. 01807, date unknown, 12 pages.

www.mmsonline.com/columns/micro-keying-keeps-a-better-grip.aspx, Seibert, Stan, Modern Machine Shop: "Micro-Keying Keeps a Better Grip", Aug. 1, 1999.

* cited by examiner

CLAMPING SYSTEMS AND METHODS FOR PILEDRIVING

RELATED APPLICATIONS

This application claims priority of U.S. Provisional Patent Application Ser. No. 60/722,748 filed Sep. 30, 2005, the contents of which are incorporated herein by reference.

TECHNICAL FIELD

The present invention relates to clamp systems and methods for use by pile drivers and, more particularly, to clamp systems and methods adapted to allow a rebar cage to be connected to a pile driver.

BACKGROUND OF THE INVENTION

Construction projects often require the insertion of and removal of elongate members in the earth. Elongate members can take many forms, such as hollow cylinders (pipe piles, caissons), solid cylinders (concrete or wooden piles), and sheets (sheet piles).

To facilitate insertion or removal of an elongate member without excavation, pile driving systems and methods may be used. A pile driving system or method can employs a static or repetitive driving force along a longitudinal axis of the elongate member. A static driving force may be created by weight applied to an upper end of the elongate member and/or a gear drive or the like that applies a crowding force to the elongate member. A repetitive driving force may be created by a drop hammer, diesel hammer, or the like. When directed towards the ground, the driving force can be sufficient to cause the elongate member to enter the ground, depending upon soil conditions and the like. When directed away from the ground, the driving force extracts the elongate member from the ground.

The present invention is directed to a pile driving system or method in which a static driving force is combined with a vibrational force. A vibration system typically applies the vibrational force to the elongate member in combination with a static driving force. Under most conditions, the vibrational force significantly enhances the ability of the pile driving system or method both to insert and to extract an elongate member. When a pile driving system or method employs vibrational forces to insert or extract an elongate member, a vibration suppression system is often used to inhibit transmission of these forces back to a support system (e.g., crane, spotter) used to position the pile driving system and/or elongate member.

To ensure that the vibrational forces are effectively transmitted to the elongate member, clamping system and methods are typically employed. A clamping system or method is typically configured to apply a clamping force that substantially rigidly connects the vibrational device to the elongate member.

A clamping system for a pile driving system or method usually comprises a fixed clamp member and a movable clamp member. The fixed clamp member is substantially rigidly attached to a clamp housing, a portion of the elongate member is placed between the fixed clamp member and the movable clamp member, and the movable clamp member is displaced relative to the clamp housing such that the portion of the elongate member is gripped between fixed and movable clamp members.

The geometry of the clamp members is typically configured based on the geometry and material of the elongate member. For example, clamp members for a metal sheet pile would be generally flat, perhaps with a surface textured to increase friction between the clamp members and the pile. On the other hand, the clamp members for a wooden pile might be curved with teeth that will penetrate the wooden pile to reduce slippage.

One special form of an elongate member is a rebar cage that can be used as a pile by itself or to reinforce a poured concrete pile. A rebar cage typically comprises longitudinal bars and ring bars. The ring bars are welded around longitudinal bars to form a generally cylindrical structure that is hollow and has a discontinuous surface.

The shape and construction of a rebar cage cannot effectively be secured to a vibrational device using conventional clamp assemblies with a fixed and movable clamp member. The need thus exists for improved clamping systems and methods for elongate members such as rebar cages.

SUMMARY OF THE INVENTION

The present invention may be embodied as a clamp system for an elongate member comprising first and second clamp members, an actuator member, and an actuator system. The actuator member defines an actuator cam surface and is supported for movement between first and second actuator positions. The second clamp member defines a clamp cam surface and is supported for movement between first and second clamp positions. The actuator system displaces the actuator member between first and second actuator positions. As the actuator member moves from the first actuator position to the second actuator position, the actuator cam surface engages the clamp cam surface to cause the second clamp member to move towards the first clamp member, thereby clamping a portion of the elongate member between the first and second clamp members.

DETAILED DESCRIPTION OF THE INVENTION

Figure 1:
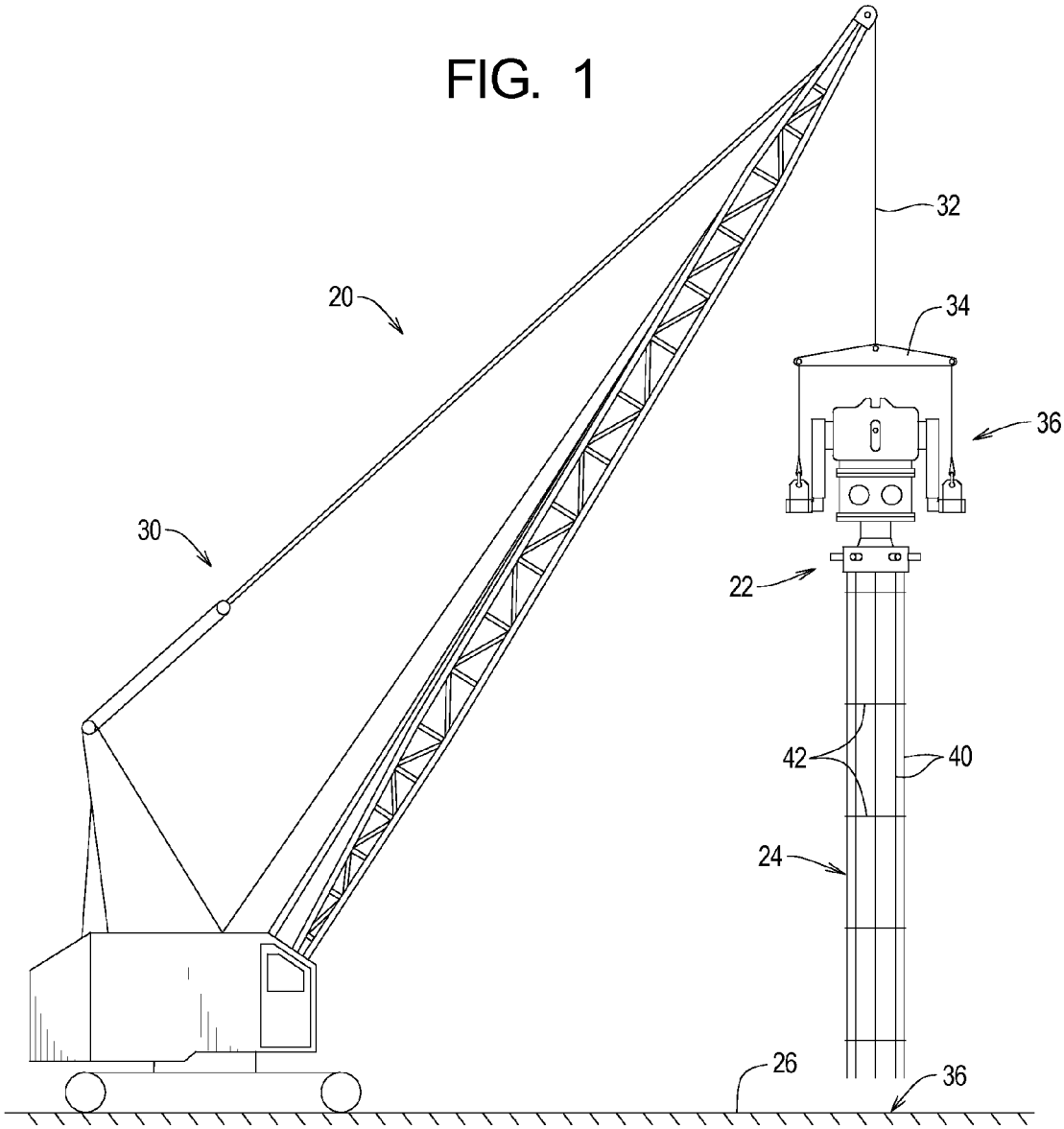
FIG. 1 is a side elevation view of a pile driving system using a clamp system of the present invention.

Referring initially to FIG. 1 of the drawing, depicted at 20 therein is a pile driving system employing a clamp system 22 constructed in accordance with, and embodying, the principles of the present invention. The clamp system 22 is configured to engage a rebar cage 24 during driving of the rebar cage 24 into a portion 26 of the earth surface.

The pile driving system 20 comprises a crane 30 from which is suspended a crane line 32 and a crane bar 34. A drive assembly 36 is attached to and suspended from the crane bar 34, and the clamp system 22 forms a part of the drive assembly 36. In the situation depicted in FIG. 1, the crane 30 locates the crane line 32 such that the rebar cage 24 is suspended above a desired location 36 on the earth surface 26.

Figure 2:
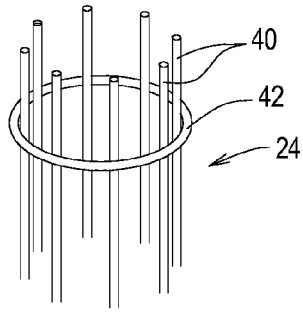
FIG. 2 is an end perspective view of a rebar cage of the type that may be clamped by the clamp system used by the pile driving system of FIG. 1.

As shown in FIGS. 1 and 2, the example rebar cage 24 comprises a plurality of longitudinal bars 40 and a plurality of ring bars 42. The longitudinal bars 40 and ring bars 42 are welded or otherwise rigidly connected such that the rebar cage 24 is relatively rigid.

Figure 3:
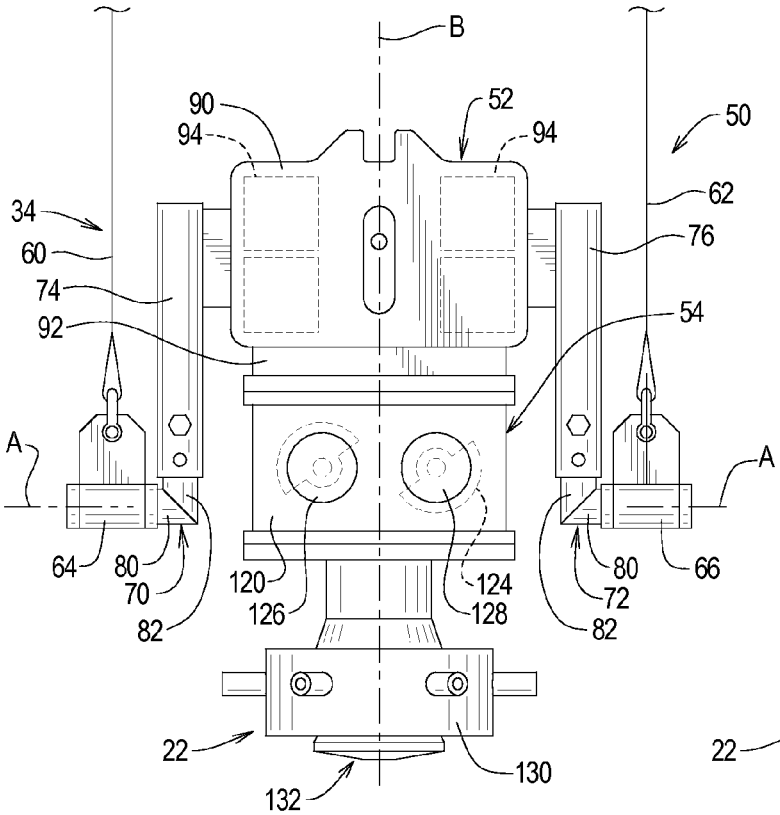
FIG. 3 is a front elevation view of a driving assembly of the pile driving system, the driving assembly incorporating the clamp system of the present invention.
Figure 4:
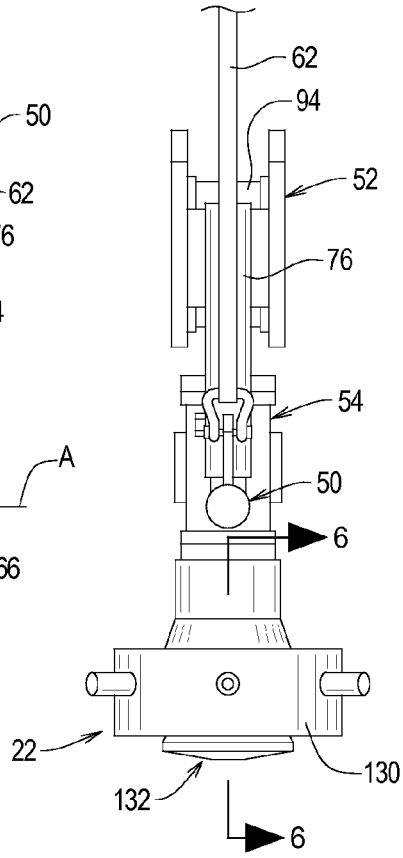
FIG. 4 is a side elevation view depicting the driving assembly of FIG. 3.
Figure 5:
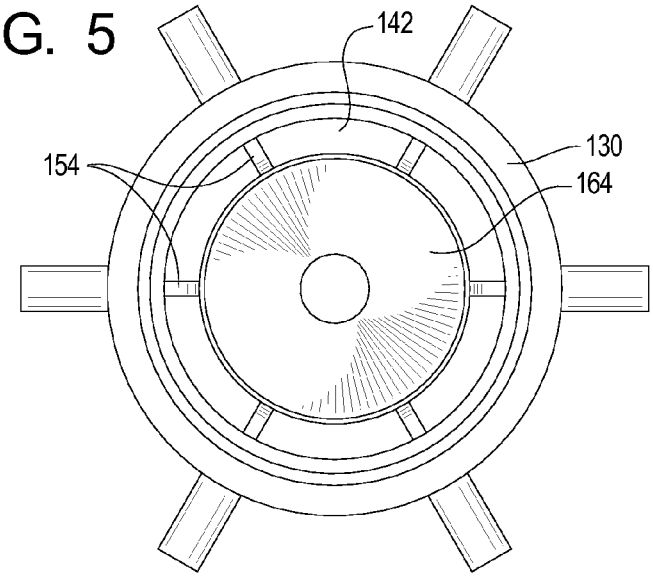
FIG. 5 is a bottom plan view depicting the clamp system of FIGS. 1 and 3.

Turning now to FIGS. 3 and 4 of the drawing, the drive assembly 36 will now be described in further detail. The drive assembly 36 comprises a lead assembly 50, a suppressor system 52, a vibro system 54, and the clamp system 22.

The lead assembly 50 comprises first and second lead lines 60 and 62 that are connected to the crane bar 34. The lead lines 60 and 62 are connected to first and second pivot yokes 64 and 66. The pivot yokes 64 and 66 in turn receive pivot pins 70 and 72. The pivot pins 70 and 72 are in turn connected to first and second side arms 74 and 76. The side arms 74 and 76 are in turn connected to the suppressor system 52.

The example pivot pins 70 and 72 of the lead assembly 50 are angle members comprising first portions 80 that are substantially collinear along a lateral axis A of the system 20 and second portions that are substantially vertical and parallel to each other and to a longitudinal axis B of the system 20.

The suppressor system 52 comprises a suppressor housing 90, a center plate 92, and resilient members 94 connected between the housing 90 and the center plate 92. The resilient members 92 inhibit transmission of forces between the housing 90 and the center plate 92. The side arms 74 and 76 are rigidly connected to the suppressor housing 90 as perhaps best shown in FIG. 4.

The vibro system 54 comprises a vibro housing 120 that rotatably supports eccentric weights 122 and 124. Motors 126 and 128 rotate the weights 122 and 124 in opposition to each other such that lateral forces are substantially cancelled and longitudinal forces are summed to create vibrational forces along a longitudinal axis B of the drive assembly 36. The vibro housing 120 is rigidly connected to the center plate 92 of the suppressor system 52 such that transmission of the vibrational forces to the lead assembly 50 is inhibited.

Referring now to FIGS. 5-10, the clamp system 22 will be described in further detail. The clamp system 22 comprises a clamp housing 130 and a radial clamp assembly 132.

The clamp housing 130 comprises a first wall portion 134, a second wall portion 136, and a third wall portion 138. As perhaps best shown in FIG. 6, the first wall portion 134 of the clamp housing 132 defines a piston chamber 140, while the third wall portion 138 defines a clamp chamber 142. A shaft opening 144 is defined by the second wall portion 136. The clamp housing 130 further comprises a mounting flange 146 that is rigidly connected to the vibro housing 120 such that vibrations of the vibro housing 120 are transmitted to the clamp housing 130.

The example radial clamp assembly 132 comprises a piston member 150, a plurality of clamp members 152, and a plurality of guide rods 154. The piston member 150 comprises a piston portion 160, a shaft portion 162, and a cam portion 164. The piston portion 160 is arranged within the piston chamber 140 and defines a curved surface 170 and first and second annular surfaces 172 and 174. The piston portion 160 and shaft portion 162 divide the piston chamber 140 into a first chamber portion 166 and a second chamber portion 168. The shaft portion 162 extends from the piston chamber 140 into the clamp chamber 142 through the shaft opening 144.

The cam portion 164 of the piston member 150 lies at least partly within the clamp chamber 142 and defines a first cam surface 176. The clamp members 152 are arranged within the clamp chamber 142 and define second cam surfaces 178 that are complementary to the first cam surface 166. More specifically, the clamp members 152 are arranged between the cam portion 164 of the piston member 150 and the third wall portion 138 of the clamp housing 136 such that the first and second cam surfaces 166 and 168 are in contact with each other.

By injecting hydraulic fluid into the chamber portions 166 and 168, the piston member 150 can be displaced relative to the clamp housing 130. In particular, by injecting fluid into the second chamber portion 168 as shown by arrow C and allowing fluid to flow out of the first chamber portion 168 as shown by arrow D in FIG. 6, fluid acts on the surface 174 of the piston portion 160. Fluid acting on the piston portion 160 causes displacement of the piston member 150 relative to the clamp housing 130 as shown by a comparison of FIGS. 6 and 7.

The first and second cam surfaces 176 and 178 engage each other such that movement of the piston member 150 along the longitudinal axis B displaces the clamp members 152 radially from the longitudinal axis B. If the piston member 150 moves towards the vibro housing 120, the clamp members 152 are displaced outwardly. If the piston member 150 moves away from the vibro housing 120, the clamp members 152 are allowed to move inwardly.

The guide rods 154 are each associated with one of the clamp members 152 and define a threaded end 180, a shaft portion 182, and a bearing portion 184. The threaded end 180 is secured to the clamp member 152 associated therewith. The shaft portions 182 extend through guide passageways 186 formed in the third wall portions 138 of the clamp housing 130.

Attached to the clamp housing 130 at each of the guide passageways 186 are spring housings 190. Each spring housing 190 defines a spring chamber 192, and a biasing spring 194 is contained within each spring chamber 192. The bearing portions 184 of the guide rods 154 are located within the spring chambers 192. The biasing springs 194 act on the bearing portions 184 to bias the guide rods 154, and thus the clamp members 152 attached thereto, radially inwardly.

The biasing springs 194 thus hold the first and second cam surfaces in contact as the piston member 150 moves through its full range of motion. Accordingly, as the piston member 150 is displaced away from the vibro housing 120, the biasing springs 194 force the clamp members 152 radially inwardly away from the third wall portions 138.

Figure 6:
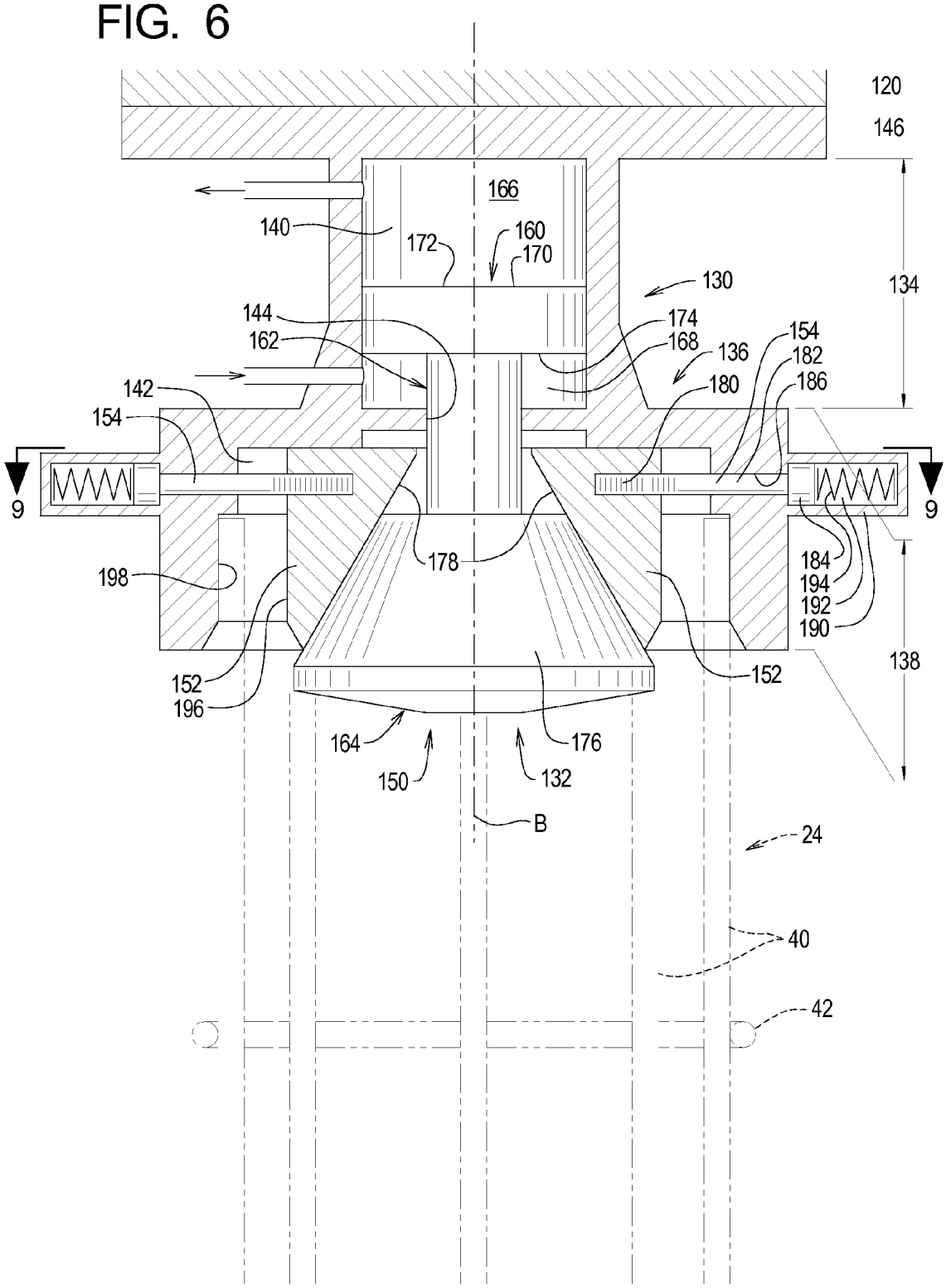
FIGS. 6 and 7 are longitudinal cutaway views of the clamp system of FIG. 3 taken along lines 6-6 in FIG. 3.
Figure 7:
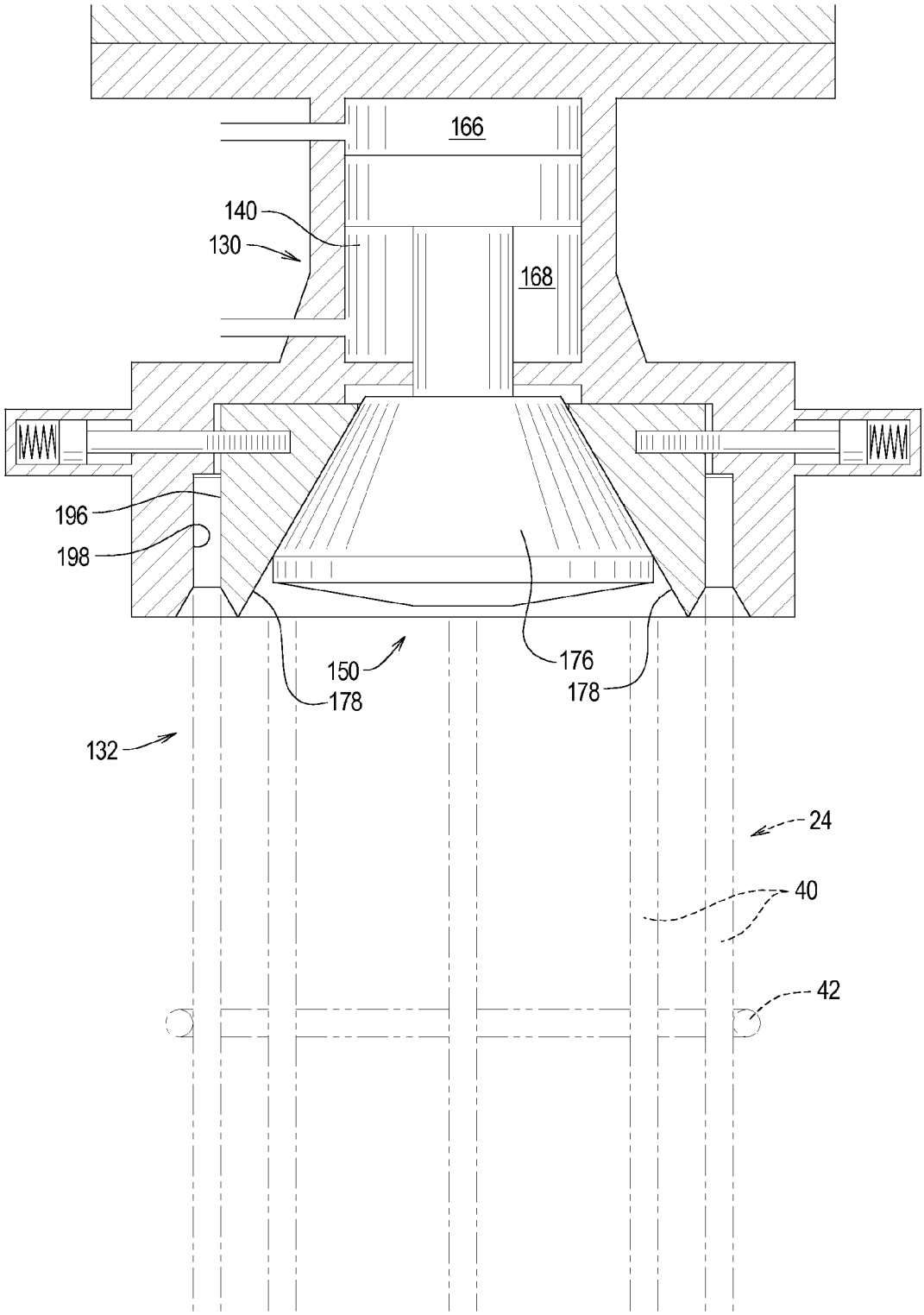
Figure 9:
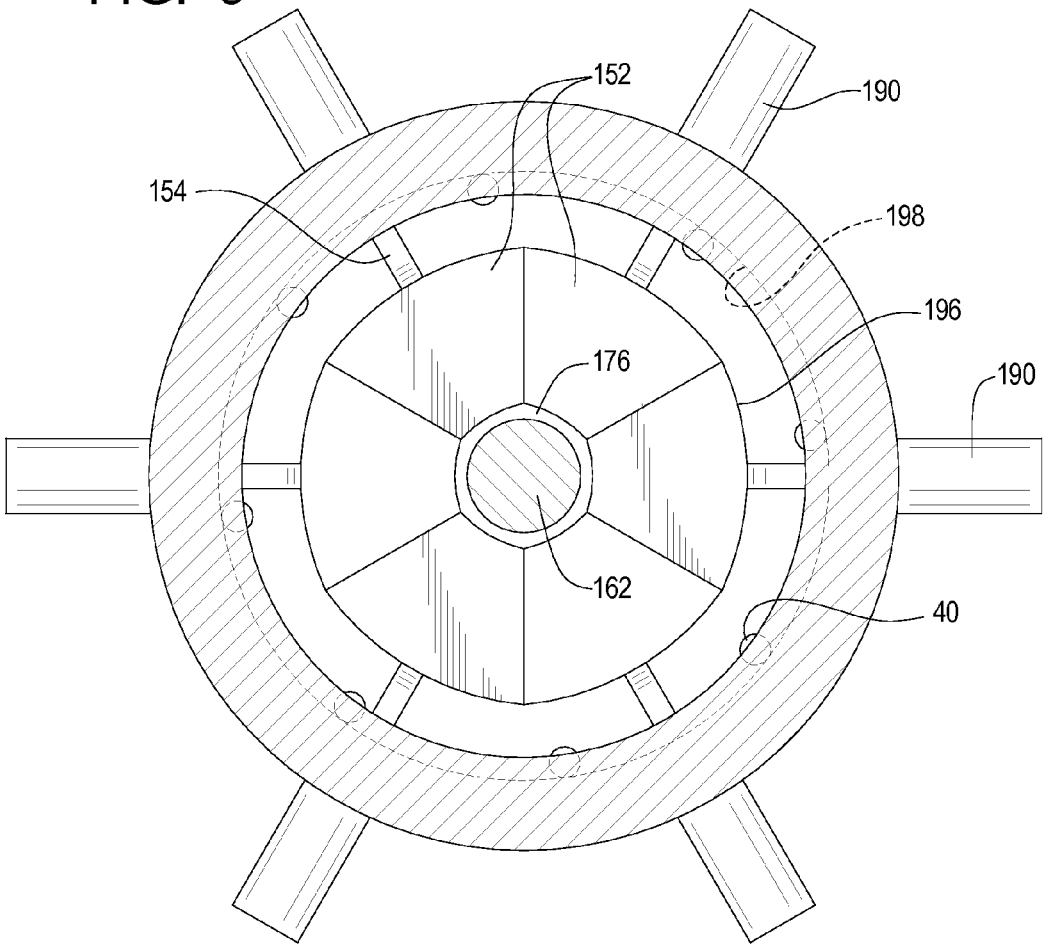
FIGS. 9 and 10 are top section views taken along lines 9-9 in FIG. 6 illustrating the radial clamp assembly in open and closed positions.
Figure 10:
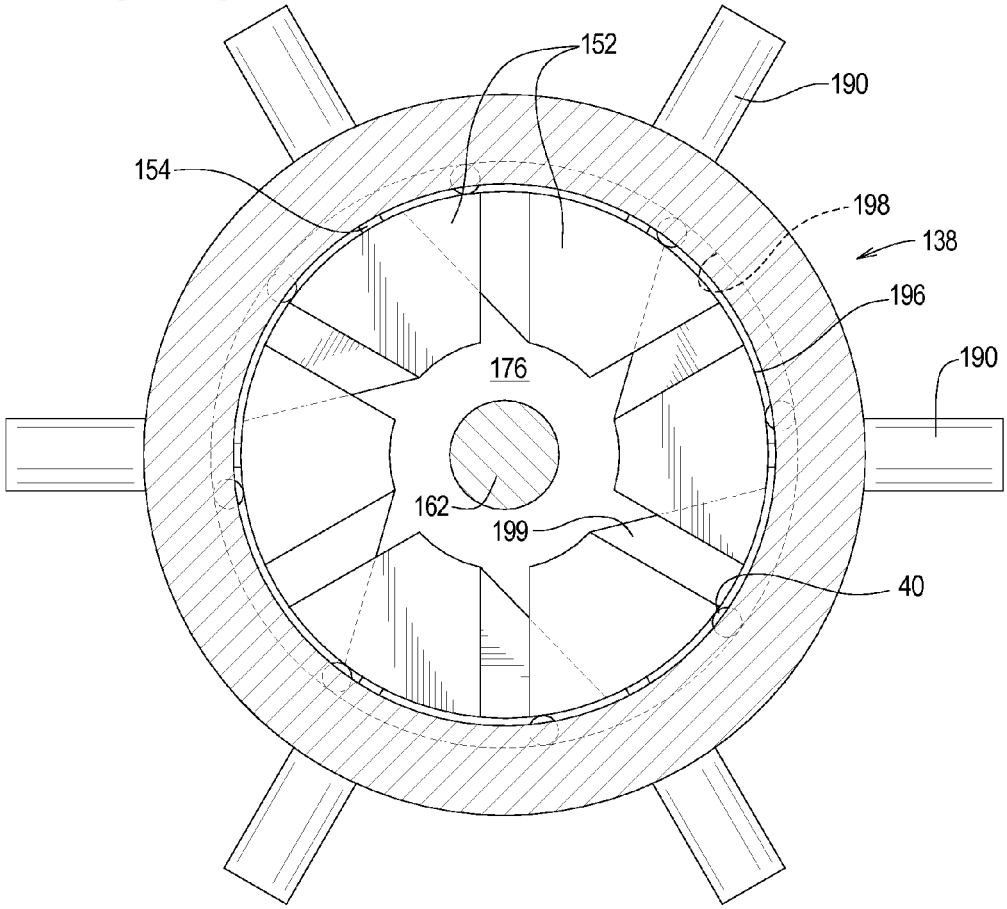

In use, the piston member 150 is displaced into a distal position shown in FIGS. 6 and 9 to allow the longitudinal bars 40 of the rebar cage 24 to be arranged between the a first clamp surface 196 of the clamp members 152 and a second clamp surface 198 of the third wall portion 138. The piston member 152 is then displaced into a proximal position as shown in FIGS. 7 and 10 such that the clamp members 152 clamp the longitudinal bars 40 of the rebar cage 24 between the first and second clamp surfaces 196 and 198. Spacer sleeves may be placed along at least part of the first clamp surface 198 to accommodate rebar cages 24 of different diameters.

Figure 8:
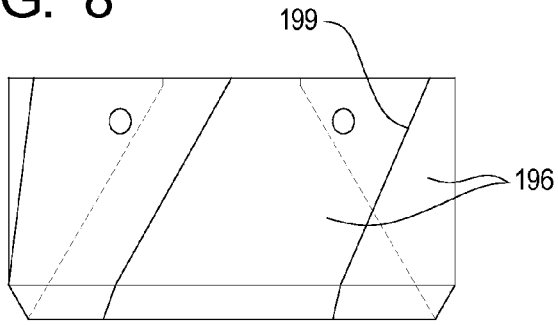
FIG. 8 depicts a side elevation view of a radial clamp assembly used by the clamp system of the present invention.

As shown in FIGS. 8 and 10, in addition to the first clamp surfaces 196, the clamp members 152 define complementary side surfaces 199 that are angled with respect to the system axes A and B. These angled side surfaces 199 overlap to ensure continuous contact between the longitudinal bars 40 and the clamp members 152 throughout the entire 360° arc defined by the second clamp surface 198 when the clamp members are in the radially outward position shown in FIGS. 7 and 10.

Figure 11:
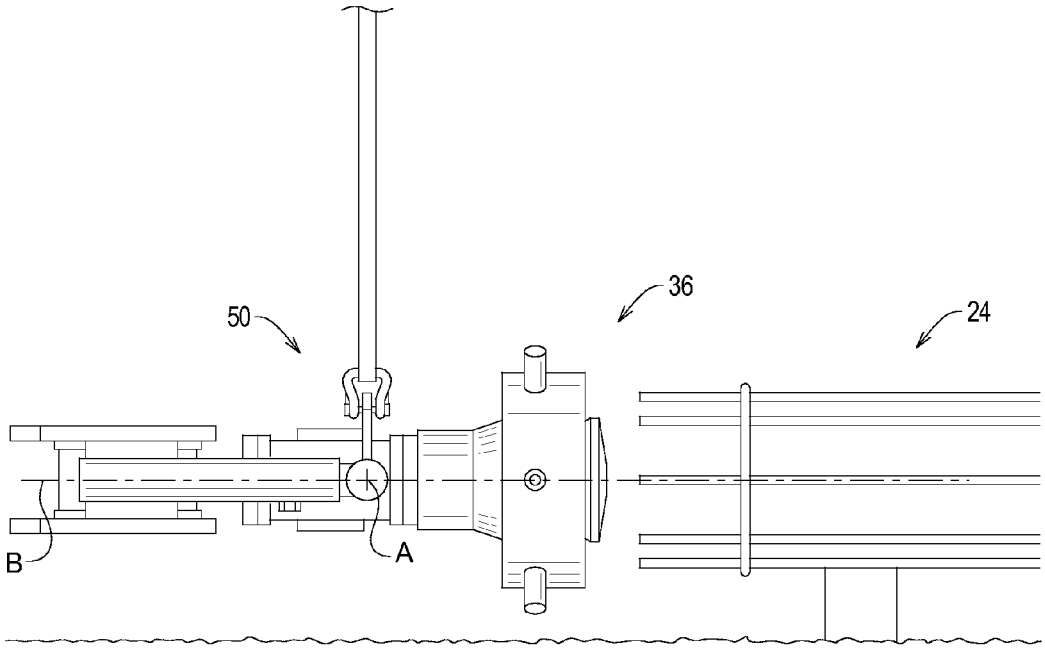
FIG. 11 is a side elevation view illustrating the engagement of the driving assembly of FIG. 3 with the rebar cage of FIG. 2.
Figure 12:
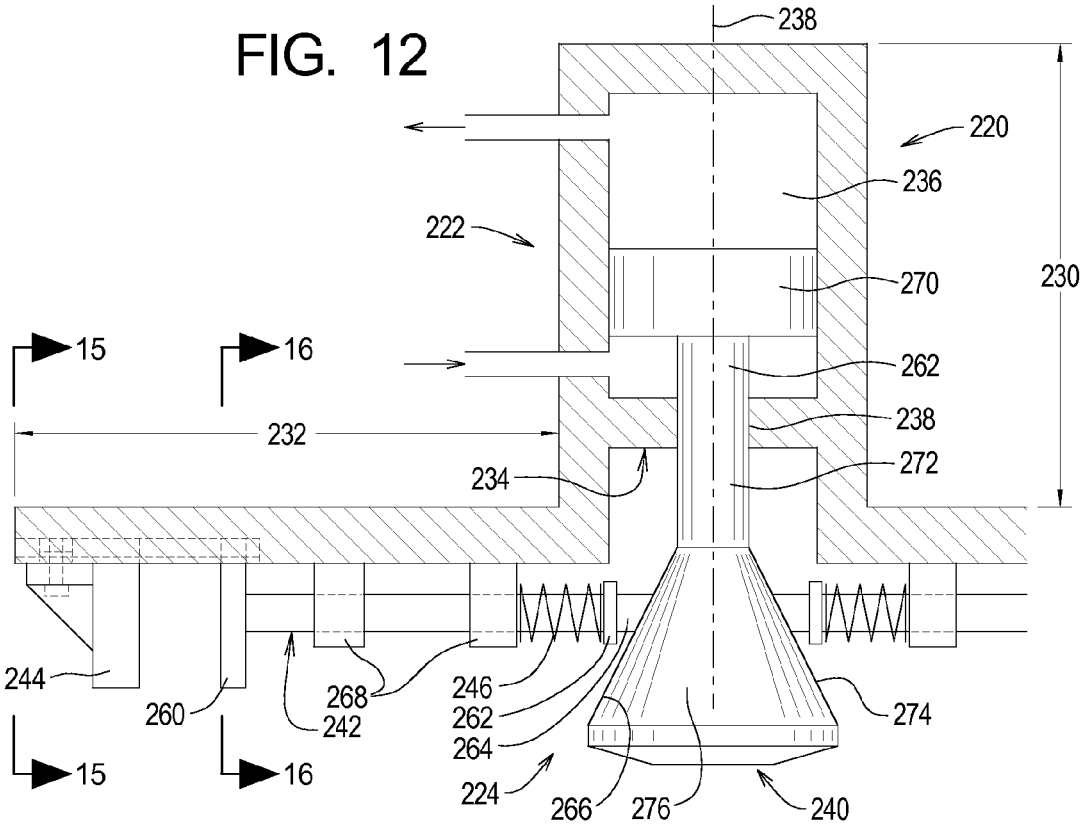
FIGS. 12 and 13 are schematic views depicting the operation of the clamp system of the present invention in unclamped and clamped configurations.

Referring now to FIG. 11, it can be seen that the lead assembly 50 is sized and dimensioned such that the entire drive system 36 can be rotated about the lateral axis A until the longitudinal axis is substantially horizontal. The lead assembly 50 thus allows the drive system 36 to be displaced to engage the rebar cage 24 when the rebar cage 24 itself is substantially horizontal (e.g., stored parallel to the ground).

Referring now to FIGS. 12-16, depicted therein is a second embodiment of a clamp system 220 constructed in accordance with, and embodying the principles of the present invention.

The clamp system 220 comprises a clamp housing 222 and a clamp assembly 224. The clamp housing 222 defines a chamber portion 230, a clamp portion 232, and a divider wall 234. The chamber portion 230 defines a piston chamber 236, and the divider wall 234 defines a shaft opening 238. The chamber portion 230 further defines a longitudinal system axis 238. The example clamp assembly 224 comprises a piston member 240, a plurality of first clamp members 242, a plurality of second clamp members 244, and a plurality of biasing springs 246.

Figure 14:
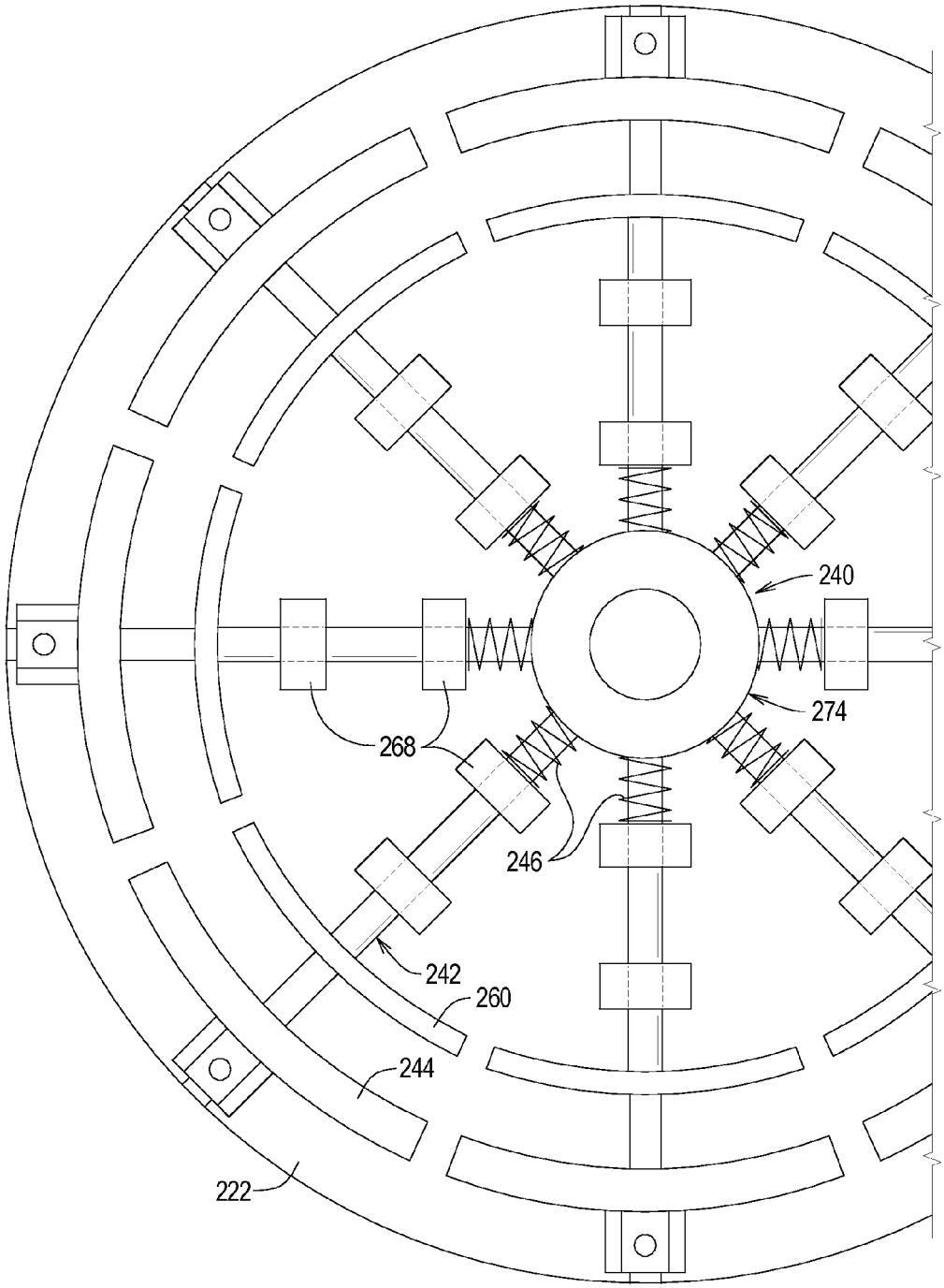
FIG. 14 is a top plan cutaway view depicting the radial clamp assembly of the present invention.

The first clamp members 242 each comprise an engaging portion 260, a spring collar 262, and a cam portion 264. First cam surfaces 266 are formed on each of the cam portions 264. Guide portions 268 extend from the clamp housing 222 to support the clamp members 242 for radial movement relative to the system axis 238 as generally shown in FIG. 14. The biasing springs 246 are located between the spring collars 262 and one of the guide portions 268 such that the biasing springs 246 force the clamp members 242 radially inwardly towards the system axis 238.

The piston member 240 defines a piston portion 270, a shaft portion 272, and a cam portion 274. The cam portion defines a second cam surface 276. The piston portion 270 is arranged in the piston chamber 236, while the shaft portion 272 extends through the shaft opening 238. The cam portion 274 is arranged such that the first cam surfaces 266 are held by the biasing springs 246 in contact with the second cam surface 276.

Figure 13:
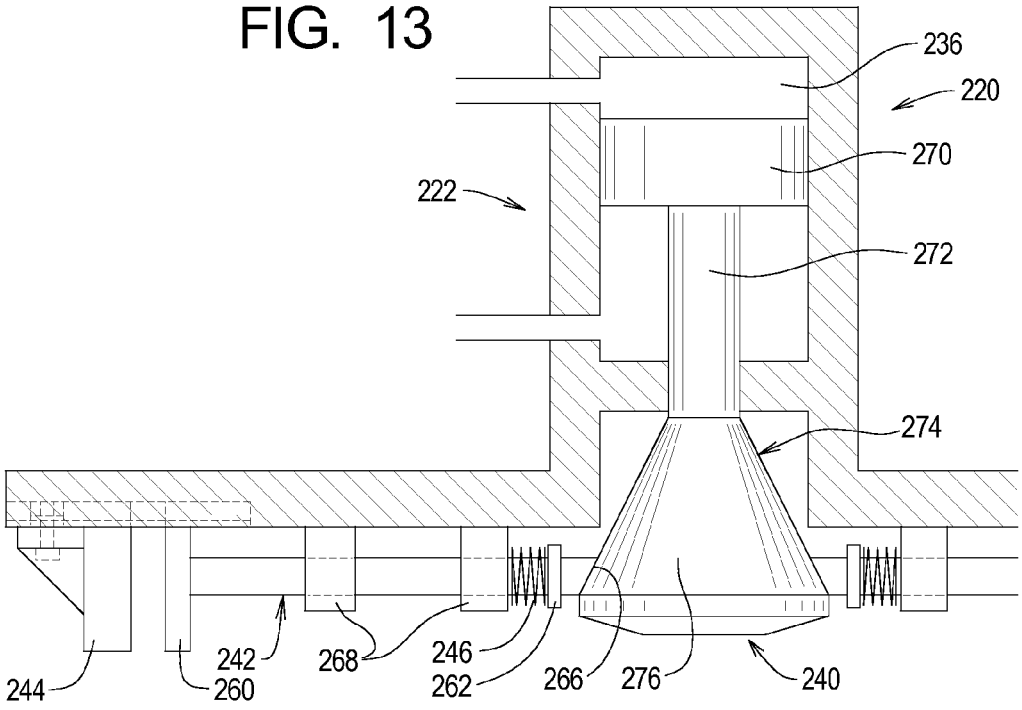

As generally described above, the introduction of hydraulic fluid into the piston chamber 236 forces the piston member 240 in either direction along the longitudinal system axis 238. Displacing the piston member 240 along system axis 238 such that the cam portion 274 moves closer to the divider wall 234 moves the clamp members 242 radially outwardly as shown in FIG. 13. Displacing the piston member 240 in the opposite direction allows the biasing springs 246 to move the clamp members 242 radially inwardly to the position shown in FIG. 12. A rebar cage such as the cage 24 described above may thus be clamped between the engaging portions 260 and the second clamp members 244.

Figure 15:
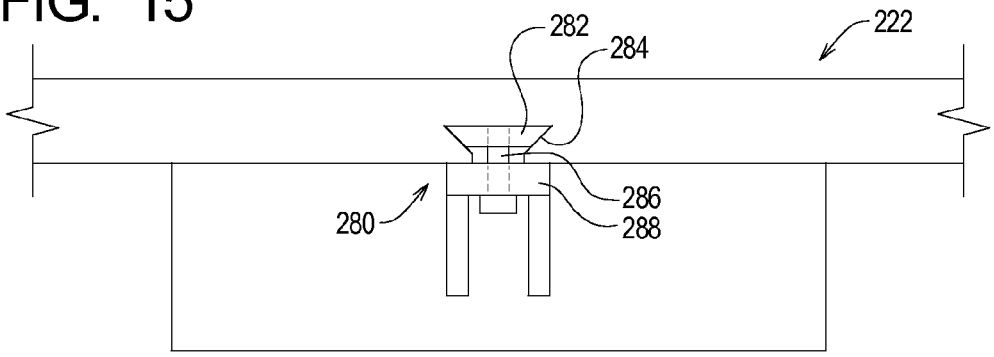
FIG. 15 is a section view taken along lines 15-15 in FIG. 12.
Figure 16:
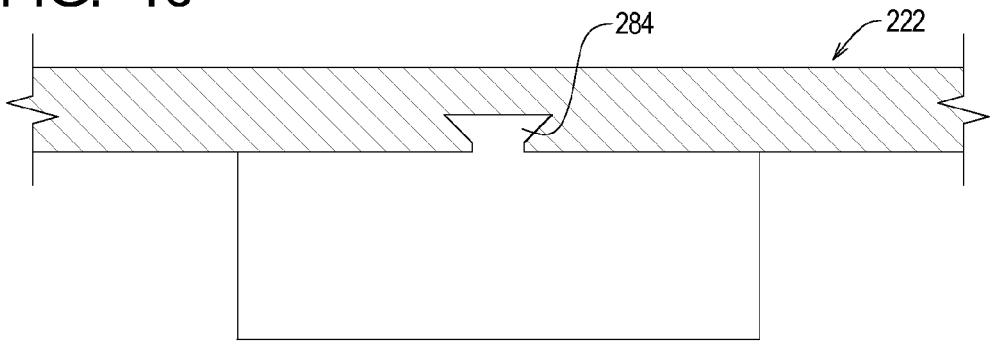
FIG. 16 is a section view taken along lines 16-16 in FIG. 13.

FIGS. 15 and 16 illustrate a clamp adjusting system 280 that may be used as part of the clamp systems 22 and 220 of the present invention. In particular, the second clamp members 244 may comprise lock members 282 that are slidably mounted in radially oriented dovetail slots 284 formed in the clamp portion 232 of the clamp housing 222. Bolts 286 extend through a mounting plate portion 288 of the second clamp members 244 and into the lock members 282. The bolts 286 may be loosened to allow relative movement between the clamp members 244 and the clamp housing 222 and or tightened to inhibit such relative movement.

The clamp adjusting system 280 thus allows the relative position between the clamp members 244 and the clamp housing 222 to be adjusted to accommodate different rebar cages.

While an effort has been made to describe some alternatives to the preferred embodiment, other alternatives will readily come to mind to those skilled in the art. Therefore, it should be understood that the invention may be embodied in other specific forms without departing from the spirit or central characteristics thereof. The present examples and embodiments, therefore, are to be considered in all respects as illustrative and not restrictive, and the invention is not intended to be limited to the details given herein.

What is claimed is:

1. A clamp system for supporting an elongate rebar cage for displacement along a longitudinal axis, the rebar cage comprising a plurality of longitudinal bars and a plurality of ring bars, comprising:

a clamp housing defining a housing engaging surface;

an actuator member defining an actuator cam surface, where the actuator member is supported for movement between first and second actuator positions;

a plurality of clamp members each defining a clamp cam surface, a clamp engaging surface, and a pair of side surfaces, where each of the clamp members is supported for movement between first and second clamp positions;

an actuator system for displacing the actuator member between the first and second actuator positions; whereby as the actuator member moves from the first actuator position to the second actuator position, the actuator cam surface engages the clamp cam surfaces to cause the clamp members to move towards the clamp housing such that end portions of the plurality of longitudinal bars are gripped between at least one of the clamp engaging surfaces and the housing engaging surface; and the side surfaces of adjacent movable clamp members extend at angles relative to the longitudinal axis such that as the clamp members move between the first and second clamp positions, the side surfaces of adjacent movable clamp members overlap with respect to the longitudinal axis, each of the end portions of the longitudinal bars are engaged by at least one of the clamp engaging surfaces, and at least one of the end portions of the longitudinal bars is engaged by two of the clamp engaging surfaces.

2. A clamp system as recited in claim 1, in which the clamp members and the actuator member are supported for movement relative to the clamp housing.

3. A clamp system as recited in claim 1, further comprising a biasing structure that maintains the clamp cam surfaces in contact with the actuator cam surface.

4. A clamp system as recited in claim 1, in which a clamp cam surface profile of the clamp cam surfaces substantially matches an actuator cam surface profile of the actuator cam surface.

5. A clamp system as recited in claim 4, in which the clamp cam surface profile and the actuator cam surface profile are portions of a frustoconical shape.

6. A clamp system as recited in claim 1, in which the actuator member moves along the longitudinal axis.

7. A clamp system as recited in claim 6, in which a line extending through each of the first and second clamp positions is substantially perpendicular to the longitudinal axis.

8. A clamp system as recited in claim 1, in which a line extending through the first and second clamp positions is substantially perpendicular to the longitudinal axis.

9. A clamp system as recited in claim 1, wherein lines extending through the first and second clamp positions of each of the clamp members substantially radially extend from the longitudinal axis.

10. A clamp system as recited in claim 1, in which the actuator system comprises a piston chamber, wherein:

the actuator member is formed by a piston member defining a piston portion, a shaft portion, and a cam portion;

the piston portion of the piston member is arranged within the piston chamber; and hydraulic fluid is injected into the piston chamber to cause the piston member to move between the first and second actuator positions.

11. A clamp system for supporting an elongate rebar cage for displacement along a longitudinal axis, the rebar cage comprising a plurality of longitudinal bars and a plurality of ring bars, comprising:

a housing defining a clamp surface, a piston chamber, and a longitudinal axis;

a piston member defining a piston portion, a shaft portion, and a cam portion, where the actuator member is supported for movement along the longitudinal axis of the housing;

a plurality of clamp members each defining a clamp cam surface, a clamp engaging surface, and a pair of side surfaces, where the clamp members are each supported for movement between first and second clamp positions relative to the housing;

an actuator system for displacing the piston member along the longitudinal axis; whereby as the piston member moves along the longitudinal axis, the cam portion engages the clamp cam surfaces to cause the clamp members to move radially outwardly towards the clamp surface to engage end portions of the longitudinal bars; and the side surfaces of adjacent movable clamp members extend at angles relative to the longitudinal axis such that as the clamp members move between the first and second clamp positions, the side surfaces of adjacent movable clamp members overlap with respect to the longitudinal axis, each of the end portions of at least one of the longitudinal bars are engaged by at least one of the clamp engaging surfaces, and at least one of the end portions of the longitudinal bars is engaged by two of the clamp engaging surfaces.

12. A clamp system as recited in claim 11, further comprising a plurality of springs, where each spring applies a biasing force on one of the clamp members to maintain the clamp cam surfaces in contact with the cam portion of the piston member as the piston member moves along the longitudinal axis.

13. A clamp system as recited in claim 11, in which:

each clamp cam surface defines a clamp cam surface profile;

the cam portion of the piston member defines an actuator cam surface profile; and the clamp cam surface profiles substantially match the actuator cam surface profile.

14. A clamp system as recited in claim 13, in which the clamp cam surface profile and the actuator cam surface profile are portions of a frustoconical shape.

* * * * *